US007490977B2

(12) United States Patent
Zaugg

(10) Patent No.: US 7,490,977 B2
(45) Date of Patent: Feb. 17, 2009

(54) TIMEPIECE INCLUDING A POWER RESERVE INDICATOR DEVICE

(75) Inventor: Alain Zaugg, Le Brassus (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 12/043,342

(22) Filed: Mar. 6, 2008

(65) Prior Publication Data

US 2008/0225646 A1 Sep. 18, 2008

(30) Foreign Application Priority Data

Mar. 13, 2007 (EP) ..... 07104055

(51) Int. Cl.
*G04B 9/00* (2006.01)

(52) U.S. Cl. ..... 368/210; 368/212

(58) Field of Classification Search ..... 368/140, 368/142, 145–147, 204–213
See application file for complete search history.

(56) References Cited

U.S. PATENT DOCUMENTS

| | | | | | |
|---|---|---|---|---|---|
| 790,509 | A | * | 5/1905 | Mazer | 368/212 |
| 790,510 | A | * | 5/1905 | Mazer | 368/212 |
| 942,659 | A | * | 12/1909 | Ohlson | 368/212 |
| 1,937,310 | A | | 11/1933 | Bornfriend | |
| 2,670,592 | A | * | 3/1954 | Jeanneret | 368/210 |
| 2,720,747 | A | * | 10/1955 | Meyer | 368/210 |
| 6,166,999 | A | * | 12/2000 | Jujo et al. | 368/66 |
| 6,685,352 | B1 | * | 2/2004 | Capt et al. | 368/206 |

FOREIGN PATENT DOCUMENTS

| | | |
|---|---|---|
| DE | 1638800 | 1/1952 |
| EP | 1 074 897 | 2/2001 |
| FR | 425 795 | 6/1911 |

OTHER PUBLICATIONS

European Search Report issued in corresponding application No. EP 07 10 4055, completed Jan. 8, 2008.

* cited by examiner

*Primary Examiner*—Vit W Miska
(74) *Attorney, Agent, or Firm*—Griffin & Szipl, P.C.

(57) ABSTRACT

The present invention concerns a timepiece including a movement fitted with a power reserve indicator device, said timepiece including a barrel closed by a cover, a mainspring housed in said barrel and respectively connected to a barrel arbour and means for winding said mainspring, said indicator device including a differential gear kinematically connected by a first input to the barrel arbour, by a second input to the barrel and by an output to a power reserve indicator member and wherein the differential gear frame is arranged coaxially to the barrel arbour, characterized in that the second differential gear input is secured to the barrel cover, in that the differential gear output is formed by an inner toothed crown, in that the inner toothed crown is kinematically connected to the first input by at least first and second planetary wheel sets meshed with each other and in that the at least two planetary wheel sets are carried by the cover.

13 Claims, 2 Drawing Sheets

TIMEPIECE INCLUDING A POWER RESERVE INDICATOR DEVICE

This application claims priority from European Patent Application No. 07104055.4, filed Mar. 13, 2007, the entire disclosure of which is incorporated herein by reference.

FIELD OF THE INVENTION

The present invention concerns a timepiece including a power reserve indicator device, i.e. a device for indicating to the wearer the degree of winding of the barrel spring of a mechanical timepiece.

BACKGROUND OF THE INVENTION

Timepieces including devices for providing this power reserve indication are devised to take account of the rotation of the ratchet wheel during winding of the barrel spring and the rotation of the barrel when the barrel spring is let down. In order to do this, most of these known devices implement a differential gear. A device of this type is disclosed, for example, in EP Patent No. 1 074 897 wherein the two differential inputs are respectively connected to the toothing of the barrel drum and to that of the ratchet wheel, the differential gear output being connected to an indicator member.

In order to display the number of barrel spring winding turns, which is generally of the order of 10 for barrels with a power reserve of the order of 2 days, using an indicator member of the type moving opposite a scale extending at the very most over 360°, reduction wheels have to be associated with the different gear. These reduction gears are typically arranged between the drum barrel and the first differential gear input, between the ratchet wheel and the second differential gear input and between the differential gear output and the indicator member. The presence of these reduction gears is ill suited to an advantageous embodiment is some specific cases, particularly when the movement includes numerous complications multiplying the number of parts and that space available around the barrel is relative limited. Moreover, the inherent construction clearances present in these reduction gears lead to inaccuracies in the power reserve display. These display inaccuracies are greater the greater the arc along which the power reserve indication is displayed.

There is also known from DE Utility Model No. 1638800U a power reserve indicator using a plane differential gear with a double satellite wheel arranged between the barrel bar and the barrel cover for the purpose of omitting the winding and let down reduction trains. However, the reduction ratio offered by this type of differential gear does not allow the power reserve to be displayed over a small arc of a circle, for example of the order of 30° without a display reduction train. Moreover, although this power reserve device is compact horizontally, it has a significant space requirement heightwise, which impedes the use thereof in movements of small thickness.

It is an object of the present invention to overcome the aforementioned problems and drawbacks, in addition to others, by proposing a timepiece including a power reserve indicator that is compact horizontally and heightwise and is of very simple construction, while creating a more judicious arrangement of the power reserve indicator device elements.

It is another object of the invention to provide a timepiece including a power reserve indicator device that limits or omits the winding, let down and power reserve display reduction trains.

It is another object of the invention to provide a timepiece including a power reserve indicator device with improved power reserve display accuracy.

It is yet another object of the invention to provide a timepiece including a power reserve indicator device that can display the power reserve over an arc of a circle of less than 30° without any reduction trains.

SUMMARY OF THE INVENTION

The present invention therefore concerns a timepiece including a movement fitted with a power reserve indicator device, said timepiece including a barrel closed by a cover, a spring housed in the barrel and respectively connected to an arbour of the barrel and to said barrel, a going train driven by said barrel and means for winding said spring, said indicator device including a differential gear kinematically connected by a first input to the barrel arbour, by a second input to the barrel and by one output to a power reserve indicator member, and wherein the differential gear frame is arranged coaxially to the barrel arbour, characterized in that the second input of the differential gear is secured to the barrel cover, in that the output of the differential gear is formed by an inner toothed crown, in that the inner toothed crown is kinematically connected to the first input by at least first and second planetary wheels meshed with each other and in that the at least two planetary wheels are carried by the cover.

Owing to these features, the present invention provides a power reserve indicator device that is compact and simple and able to reduce to a minimum the number of winding and let down reduction trains. This solution also provides a power reserve indicator that is at least partially integrated in the barrel cover or bottom, which substantially reduces the space requirement of said indicator.

According to a preferred feature of the invention, the indicator member is directly carried by said inner toothed crown forming the output of the differential gear. This embodiment allows the display reduction train to be omitted provided that the power reserve indicator member is integrated in the differential gear.

BRIEF DESCRIPTION OF THE DRAWINGS

Other features and advantages of the present invention will appear more clearly upon reading the following detailed description of an example embodiment of the power reserve indicator device according to the invention, this example being given purely by way of non-limiting illustration, with reference to the drawings, in which.

DETAILED DESCRIPTION OF THE ILLUSTRATIVE EMBODIMENTS

Figure 1:
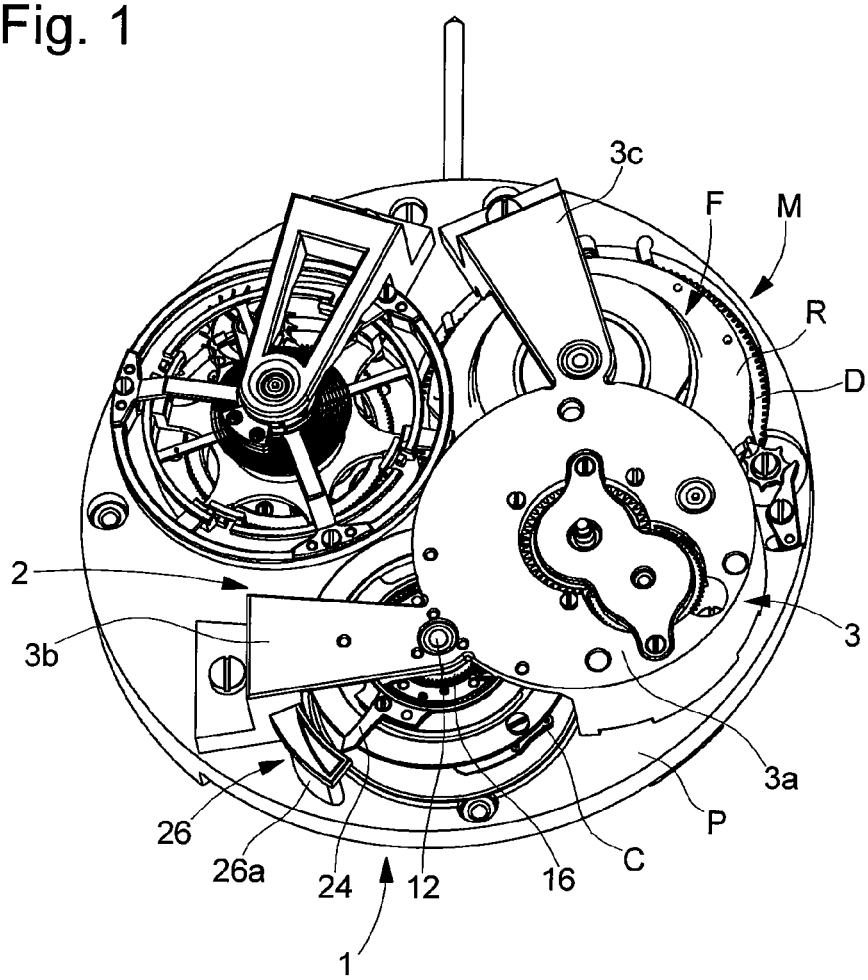
FIG. 1 is a perspective view of a timepiece movement fitted with a power reserve indicator device according to the invention.
Figure 5:
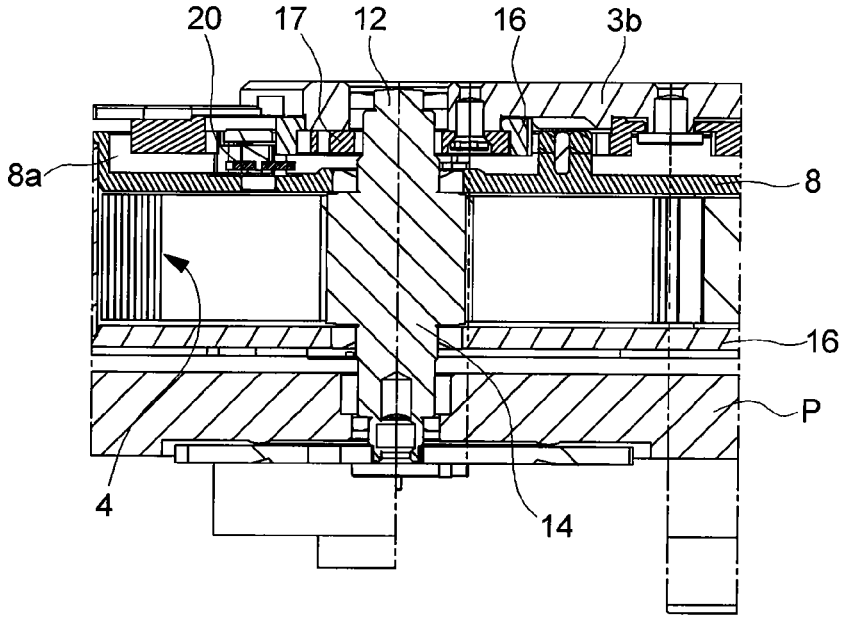
FIG. 5 is a cross-section along the line V-V of FIG. 1.

The views of FIGS. 1 to 5 partially illustrate a timepiece of the wristwatch type, for example, fitted with a power reserve indicator device in accordance with the present invention and designated as a whole by the general reference numeral 1. The watch includes a watch movement M including a bottom plate P on which a barrel 2 is mounted housing a mainspring 4. Barrel 2 includes, in a conventional manner a drum 6 closed by a cover 8 and a back cover 10. Barrel 2 is mounted to rotate freely on the barrel arbour 12, secured to the core 14. Mainspring 4 is hooked by the inner end thereof to core 14 and by the outer end thereof to the inner wall of drum 6. Barrel 2 is mounted in a conventional manner between the bottom plate P of the movement and a bridge 3 including a central portion 3*a* from which a bridge branch 3*b* and a bridge branch 3*c* extend.

In the example illustrated, the power reserve indicator device 1 is used in connection to a barrel associated with a fusee F also mounted on bottom plate P via bridge branch 3*c*. A chain C, only one link of which is shown in the drawing, is attached by a first end to the barrel drum 6. Chain C is gradually wound onto drum 6 from fusee F to which it is secured by a second end during let down of the barrel. Fusee F is conventionally associated with a ratchet R and includes a toothed portion D meshed, on the one hand, with a going train and on the other hand with a winding train. In this example, the barrel arbour 12 is fixed relative to the movement plate P. Barrel arbour 12 is mounted between plate P and bridge branch 3*b*. Bridge branch 3*b* also carries, on the face thereof arranged opposite cover 8, a toothed wheel 16 forming a first differential gear input, which will be described in more detail below. The toothed wheel 16 is friction mounted on bridge branch 3*b* via a spring ring 17 secured to bridge branch 3*b*. The second differential gear input is formed by barrel 4 and more specifically by the cover 8 secured to drum 6, which can pivot about barrel arbour 12 with the barrel when the latter is letting down. Cover 8, which thus forms the frame of the differential gear is therefore formed coaxially to the barrel arbour. Cover 8 carries a first planetary wheel set 18 including a first wheel 18*a* and a second wheel 18*b* coaxial to wheel 18*a*. Wheel 18*a* is meshed with wheel 16, whereas wheel 18*b* is meshed with a second planetary wheel set 20, which in turn meshes with a moving inner toothed crown 22, which forms the differential gear output. Crown 22 carries a display member formed of a power reserve hand 24 which, depending upon the relative position that it occupies opposite a marking 26 borne by plate P via a leg 26*a*, indicates to the wearer the available power reserve as a function of the number of winding turns of the mainspring.

Figure 2:
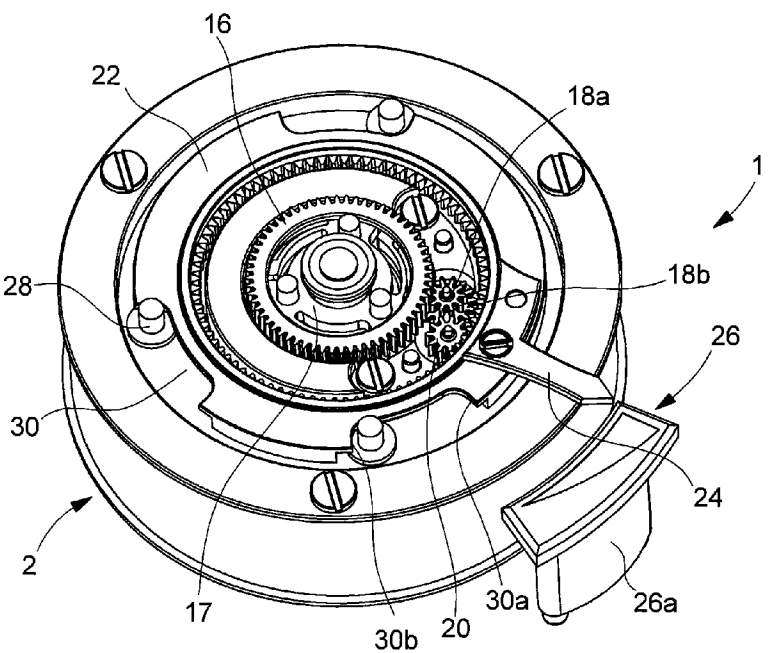
FIG. 2 is a perspective view of the power reserve indicator mechanism according to the invention in which the barrel bar has been omitted.
Figure 3:
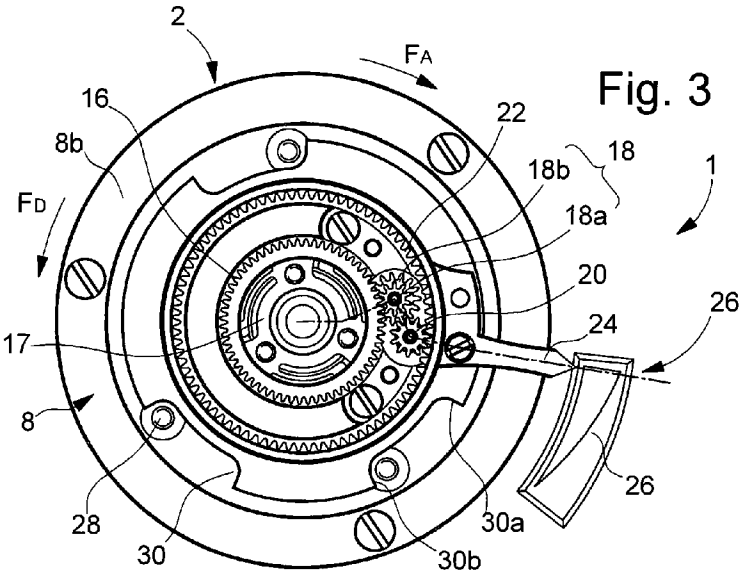
FIG. 3 is an elevation view of the power reserve indicator device according to the invention.
Figure 4:
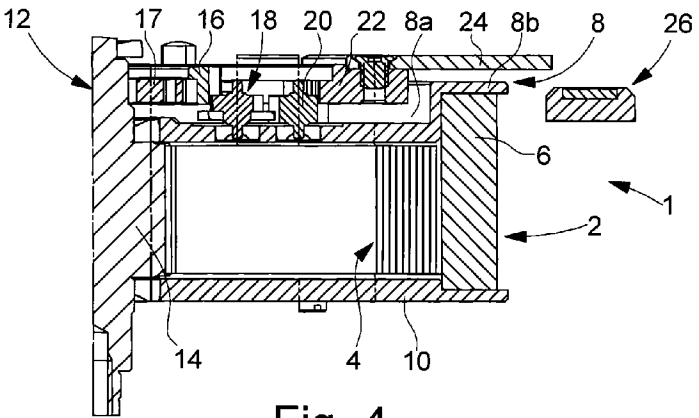
FIG. 4 is a cross-section along the line IV-IV of FIG. 3.

Referring more particularly to FIGS. 2 and 3, it can also be seen that the power reserve indicator device according to the invention further includes means 28, 30 for limiting the angular travel of the wheel with an inner toothing 22 such that hand 24 moves between two fixed and defined winding and let down end positions corresponding respectively to the end degree of winding or let down of marking 26. In the example illustrated, limiting means 28, 30 include three studs 28 secured to bridge 3, studs 28 each moving into an aperture 30 arranged in the inner toothed wheel 22. Preferably, apertures 30 are hollows open outwards arranged in the periphery of wheel 22, these apertures 30 each defining two radial stop surfaces 30*a* and 30*b* for the associated stud 28.

It will also be noted in the example illustrated, that barrel cover 8 includes a central recess 8*a* set back relative to the peripheral edge 8*b* thereof and that the inner toothed wheel 22 extends substantially into the plane of edge 8*b* of cover 8. This arrangement advantageously integrates the power reserve display device in the barrel and limits the space requirement thereof heightwise in the movement to a maximum.

The differential gear wheels and in particular the gear ratios of wheels 16, 18*a*, 18*b*, 20 and 22 are devised to provide, between the differential input 16 and output 22, a gear reduction comprised between 60 and 120 and preferably 80. By way of example, with a wheel 16 with 54 teeth, a wheel 18*a* with 10 teeth, a wheel 18*b* with 15 teeth, a wheel 20 with 11 teeth and a wheel 22 with 80 teeth, a ratio of $1/80^e$ is obtained, namely for 6 revolutions of the barrel there is an angular displacement of 270 of hand 22 connected to wheel 22 without any winding, reduction and display trains.

The illustrated embodiment of the power reserve device according to the invention that has just been described operates as follows.

When the timepiece is operating normally, i.e. when the mainspring is letting down, the barrel arbour 12 and the wheel are stationary. Drum 6 is being driven in rotation by mainspring 4 anti-clockwise (arrow FD, FIG. 2). Chain C connected to drum 6 is then gradually wound onto drum 6 from fusee F, which is in turn driven in rotation to provide the drive force to the going train. While doing so, wheel 18*a* of planetary wheel set 18 carried by barrel cover 8 rolls over the toothing of fixed wheel 16, also anti-clockwise. Wheel 18*b* of wheel set 18, secured in rotation to wheel 18*a*, then drives wheel 20 meshed with the inner toothing of crown 22 in the clockwise direction. Crown 22 then drives power reserve hand 24 anticlockwise opposite marking 26. Barrel drum 6 continues to drive power reserve hand 24 as has just been described until studs 28 come into contact with the radial stop surfaces 30*a* of apertures 30. In this position, power reserve hand 24 is opposite the zero graduation of marking 26, i.e. in the position in which mainspring 4 is completely let down. During let down, as a function of the power reserve that the winding of mainspring 4 can still provide, display hand 24 thus makes a progressive angular movement from the indication representing complete winding of the mainspring, to the indication representing the complete let down of mainspring 4. At that moment, chain C which was initially wound onto the fusee has been completely unwound therefrom and has been wound onto barrel drum 6.

To wind the timepiece in order to rewind the mainspring, the fusee is acted upon via the toothed portion thereof so as to rewind chain C onto the fusee from barrel 6 onto which it has been wound. Doing so sets drum 6 in rotation around barrel arbour 12 which is stationary relative to the movement plate. Drum 6 then rotates clockwise (arrow A, FIG. 2). This causes wheel 18*a* of planetary wheel set 18 carried by barrel cover 8 to roll over the toothing of fixed wheel 16, also clockwise. Wheel 18*b* of wheel set 18, secured in rotation to wheel 18*a*, then drives wheel 20, meshed with the inner toothing of crown 22, anticlockwise. Crown 22 then drives power reserve hand 24 clockwise opposite marking 26. Barrel drum 6 continues to drive power reserve hand 24 as has just been described until studs 28 come into contact with the radial stop surfaces 30*b* of apertures 30. In this position, power reserve hand 24 is opposite the 100% graduation of marking 26, i.e. in the position in which mainspring 4 is completely wound. Display hand 24 thus makes a progressive angular movement in the opposite direction to the preceding one, as a function of the power reserve that the number of winding turns of the mainspring can still provide. At this moment, chain C which was initially wound onto the barrel drum 6 has been completely unwound therefrom and has been wound onto fusee F.

It goes without saying that the invention is not limited to the embodiment that has just been described, and that modifications and variants could be envisaged without departing from the scope of the invention defined by the annexed claims.

It will be noted that the invention can be used with a conventional barrel movement regardless of whether the movement is wound manually or automatically. In the latter case, an uncoupling mechanism would have to be provided to avoid a false power reserve indication being given when the mainspring is fully wound and the bridle slides into the barrel.

In the case of application to a conventional barrel, the barrel arbour is pivotably mounted on the bottom plate and is associated with a ratchet wheel controlled by a winding train. During let down, wheel 16, which is secured to the barrel arbour, is stationary, the power reserve indication device thus operates in an identical manner to that previously described. During winding, it is the barrel drum that can be considered to be stationary. Barrel arbour 12 is thus set in rotation in the clockwise direction by a winding train such that it drives wheel set 18 anticlockwise. Train 18 in turn drives wheel 20 clockwise. Wheel 22, carrying the power reserve indicator hand, which is directly meshed with wheel 20, is thus driven anticlockwise opposite marking 26.

What is claimed is:

1. A timepiece including a movement fitted with a power reserve indicator device, said timepiece including a barrel closed by a cover, a mainspring housed in the barrel and respectively connected to a barrel arbour and to said barrel, a going train driven by said barrel and means for winding said mainspring, said indicator device including a differential gear kinematically connected by a first input to the barrel arbour, by a second input to the barrel and by a first output to a power reserve indicator member and wherein a differential gear frame is arranged coaxially to the barrel arbour, wherein a second output of the differential gear is secured to the barrel cover, wherein the first differential gear output is formed by an inner toothed crown, wherein the inner toothed crown is kinematically connected to the first input by at least first and second planetary wheel sets meshed with each other and in that said at least two planetary wheel sets are carried by the cover.

2. The timepiece according to claim 1, wherein the indicator member is directly carried by said inner toothed crown.

3. The timepiece according to claim 1, wherein the first differential gear input is formed of a toothed input wheel arranged around the barrel arbour.

4. The timepiece according to claim 3, wherein the first planetary wheel set includes a first wheel meshed with the first differential input and a second wheel meshed with the second planetary wheel, the second planetary wheel being meshed with the inner toothed crown.

5. The timepiece according to claim 3, wherein the barrel cover includes a central recess set back relative to the peripheral edge thereof, and wherein the inner toothed crown extends substantially into the plane of the edge of the cover.

6. The timepiece according to claim 1, wherein the barrel arbour is fixedly mounted in the movement and wherein the first input is secured to the barrel arbour.

7. The timepiece according to claim 3, wherein the toothed input wheel is friction mounted on the barrel arbour by means of a spring ring.

8. The timepiece according to claim 1, wherein it further includes means for limiting the angular travel of the inner toothed crown.

9. The timepiece according to claim 6, wherein said angular travel limiting means include at least one stud secured to the cover, said stud moving in an aperture arranged in the inner toothed crown.

10. The timepiece according to claim 1, wherein the differential gear wheels are arranged for providing, between the differential gear input and output, a reduction comprised between 60 and 120 and preferably 80.

11. The timepiece according to claim 1, wherein the power reserve indicator member is a hand.

12. The timepiece according to claim 7, wherein the barrel includes a drum, wherein the barrel is associated with a fusee by means of a chain connected via a first end to the drum thereof, said chain being wound onto the drum from the fusee during let down of the mainspring and wherein the fusee is associated with a ratchet and includes a toothed portion meshed with the going train.

13. The timepiece according to claim 6, wherein the toothed input wheel is friction mounted on the barrel arbour by means of a spring ring.

* * * * *